US008635713B2

(12) United States Patent
Smith

(10) Patent No.: US 8,635,713 B2
(45) Date of Patent: Jan. 28, 2014

(54) COLLAPSIBLE HAT

(75) Inventor: Shane Douglas Smith, Snohomish, WA (US)

(73) Assignee: BuySeasons, Inc., New Berlin, WI (US)

( * ) Notice: Subject to any disclaimer, the term of this patent is extended or adjusted under 35 U.S.C. 154(b) by 237 days.

(21) Appl. No.: 13/083,279

(22) Filed: Apr. 8, 2011

(65) Prior Publication Data

US 2012/0255100 A1 Oct. 11, 2012

(51) Int. Cl.
*A42B 1/20* (2006.01)

(52) U.S. Cl.
USPC ..... 2/200.3; 2/171.1

(58) Field of Classification Search
USPC ..... 2/200.3, 171, 171.03, 171.1, 209.3, 2/209.12, 171.01, 171.4–171.6, 184.5, 2/209.11, 195.1, 195.2
See application file for complete search history.

(56) References Cited

U.S. PATENT DOCUMENTS

| | | | | | |
|---|---|---|---|---|---|
| 1,598,379 | A | * | 8/1926 | Kerr | 2/171.02 |
| 1,997,395 | A | * | 4/1935 | Rosenfeld | 229/77 |
| 2,521,017 | A | * | 9/1950 | Moen et al. | 2/209.12 |
| 2,682,668 | A | | 7/1954 | Hoeflich | |
| 2,740,567 | A | * | 4/1956 | Kaufman | 223/84 |
| 3,041,628 | A | * | 7/1962 | Fish et al. | 2/209.7 |
| 3,082,429 | A | * | 3/1963 | De Villers | 2/195.7 |
| 3,221,345 | A | | 12/1965 | Berg | |
| D226,544 | S | * | 3/1973 | Veltri | D2/876 |
| D352,378 | S | * | 11/1994 | Wise | D2/876 |
| 5,428,842 | A | | 7/1995 | Wise | |
| D391,387 | S | * | 3/1998 | Pogrebitsky et al. | D2/876 |
| 6,092,239 | A | | 7/2000 | Pogrebitsky et al. | |
| 6,910,225 | B2 | | 6/2005 | Kovalenko | |

* cited by examiner

*Primary Examiner* — Amy Vanatta
(74) *Attorney, Agent, or Firm* — Foley & Lardner LLP

(57) ABSTRACT

A collapsible hat comprises a front portion, at least one band portion extending from the front portion, at least one first top portion extending from the at least one band portion, and a plurality of second top portions extending from the at least one band portion. The first top portions include a connector and the second top portions include a slot, and the connector of the first top portions are configured to extend through the slots of the second top portions.

20 Claims, 10 Drawing Sheets

COLLAPSIBLE HAT

BACKGROUND

The present disclosure generally relates to hats and costume and party apparel and/or accessories.

Costumes often make use of a hat to accomplish a desired look or image. For example, hats may be included as part of a package costume or a separately purchased accessory and may be associated with firefighter, police, superhero, sports player, and/or any other type of costume. Some costume hats may have a single configuration, such that they are sold in an already assembled and ready-for-use configuration (e.g., a solid plastic firefighter hat). Other costume hats may be sold in a collapsed form and may require some assembly prior to use. In addition to costumes, hats may be sold and used for other applications as well, such as for use with a party or gathering. For example, a hat may be sold for use with a birthday party and imprinted with a message such as "Happy Birthday!".

SUMMARY

One embodiment of the present disclosure relates to a collapsible hat. The collapsible hat includes a front portion and at least one band portion extending from the front portion. The collapsible hat further includes at least one first top portion extending from the at least one band portion. The at least one first top portion includes a connector. The collapsible hat further includes a plurality of second top portions extending from the at least one band portion. Each of the plurality of second top portions include a slot. The connector of the at least one first top portion extends through the slots of the plurality of second top portions in a use configuration.

Another exemplary embodiment relates to a collapsible hat including a plurality of flaps configured to form a top portion of the collapsible hat. The plurality of flaps include at least one first flap including a connector and a plurality of second flaps including a slot. The plurality of flaps are configured to be coupled at a single point to form the top portion of the collapsible hat by inserting the at least one connector into each of the slots of the plurality of second flaps.

Another exemplary embodiment relates to a method of producing a collapsible hat. The method includes forming a front portion of the collapsible hat and at least one band portion of the collapsible hat extending from the front portion. The method further includes forming at least one first top portion extending from the at least one band portion and forming a plurality of second top portions extending from the at least one band portion. The method further includes forming a connector in the at least one band portion and forming a slot in each of the plurality of second top portions configured to be coupled to the connector of the at least one band portion at a single point in a use configuration of the collapsible hat. The front portion, at least one band portion, at least one first top portion, and plurality of second top portions comprise a single piece of material.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring generally to the figures, a collapsible hat is shown and described. Collapsible hats made of cardboard or other similar material may be flat when the hat is not in use (e.g., in packaging in a store). The collapsible hats may then be formed via various methods (e.g., folding portions of the collapsible hat, using notches, tabs, or slots to insert portions of the collapsible hat into other portions, etc.). However, some methods of forming the hat into a use configuration may result in a cap that is not rounded. For example, some collapsible hats may be rectangular or box-shaped because of the limitations of forming the collapsible hat (e.g., folding or bending the cardboard material of the hat may not lead to a natural rounded shape).

Various embodiments disclosed herein provide a collapsible hat which may take the shape of a rounded hat (e.g., like a baseball cap) when formed. The collapsible hat may be stored in a flat configuration (e.g., the hat in its unassembled form may lay in substantially the same plane in a flat configuration) or may be formed into its use configuration. The collapsible hat in its flat configuration may include a front portion that when assembled is the front of the hat and a band portion that when assembled forms the base of the hat. The collapsible hat in its flat configuration further includes several top portions that are used to create the top of the hat in its fully formed state. One or more of the top portions or flaps of the hat include a connector and the other portions or flaps include slots that the connector may be inserted into for forming the top of the hat. The front portion, band portion, and top portions of the collapsible hat may be formed from a single piece of material. The material may be cardboard, according to an exemplary embodiment.

Figure 1:
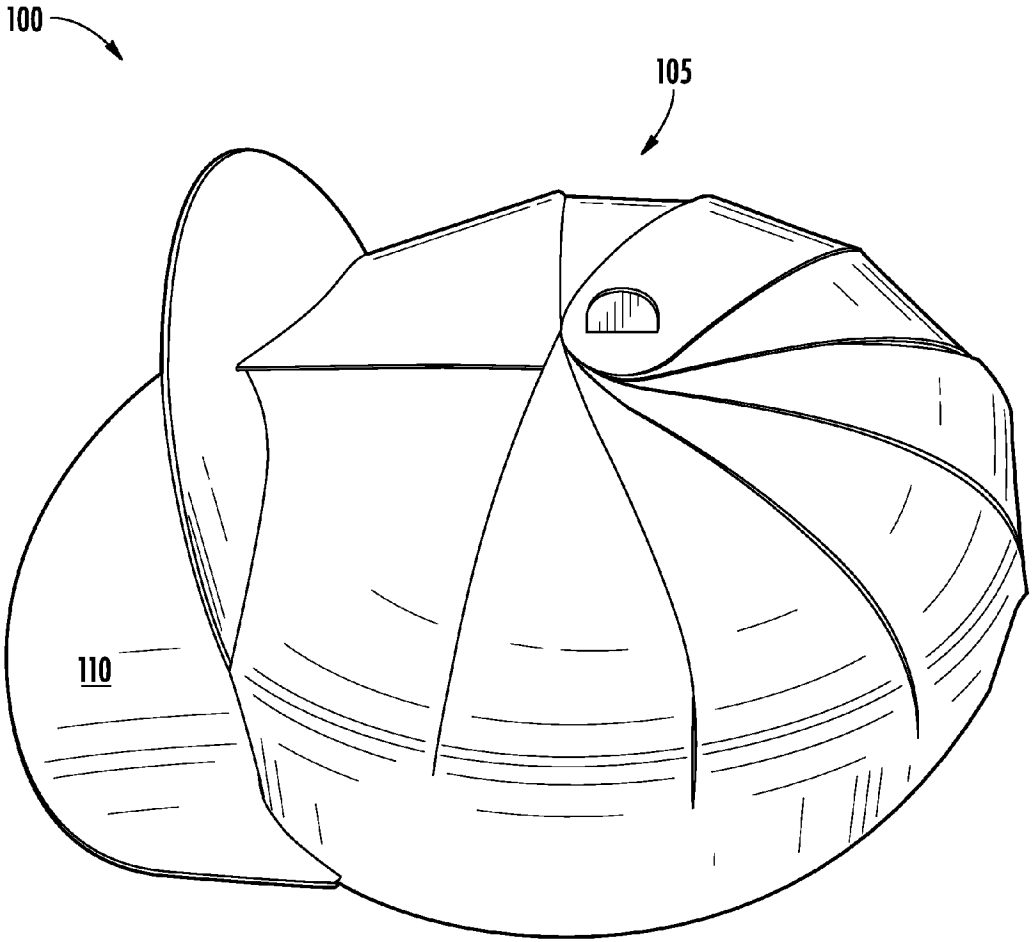
FIG. 1 is a perspective view of a collapsible hat in a fully formed state according to an exemplary embodiment.

Referring to FIG. 1, a collapsible hat 100 is shown fully formed in a use configuration, according to an exemplary embodiment. The collapsible hat 100 includes two portions, a main hat portion 105 which includes multiple top portions or flaps used to form a top rounded portion of the hat 100 and a brim 110 (e.g., a bill) that may be attached to the main hat portion 105. In the illustrated embodiment, the brim 110 is removable; in other embodiments, the brim 110 may be permanently attached to the main hat portion 105 and/or formed out of the same single piece of material as the main hat portion 105. When fully formed, the collapsible hat 100 is shown to have a generally rounded shape formed by using slots and connectors attached to the multiple portions or flaps. The rounded shape may allow the hat to sit more comfortably on a user's head and/or fit more tightly to the user's head (e.g., such that the hat is less likely to fall off) during use. In some embodiments, a transition area (e.g., an area between a band portion and top portions or between a first and second end of top portions) may have a gradual curve or rounding (e.g., as opposed to a sharp curve, such as a sharp cylindrical shape).

Figure 2:
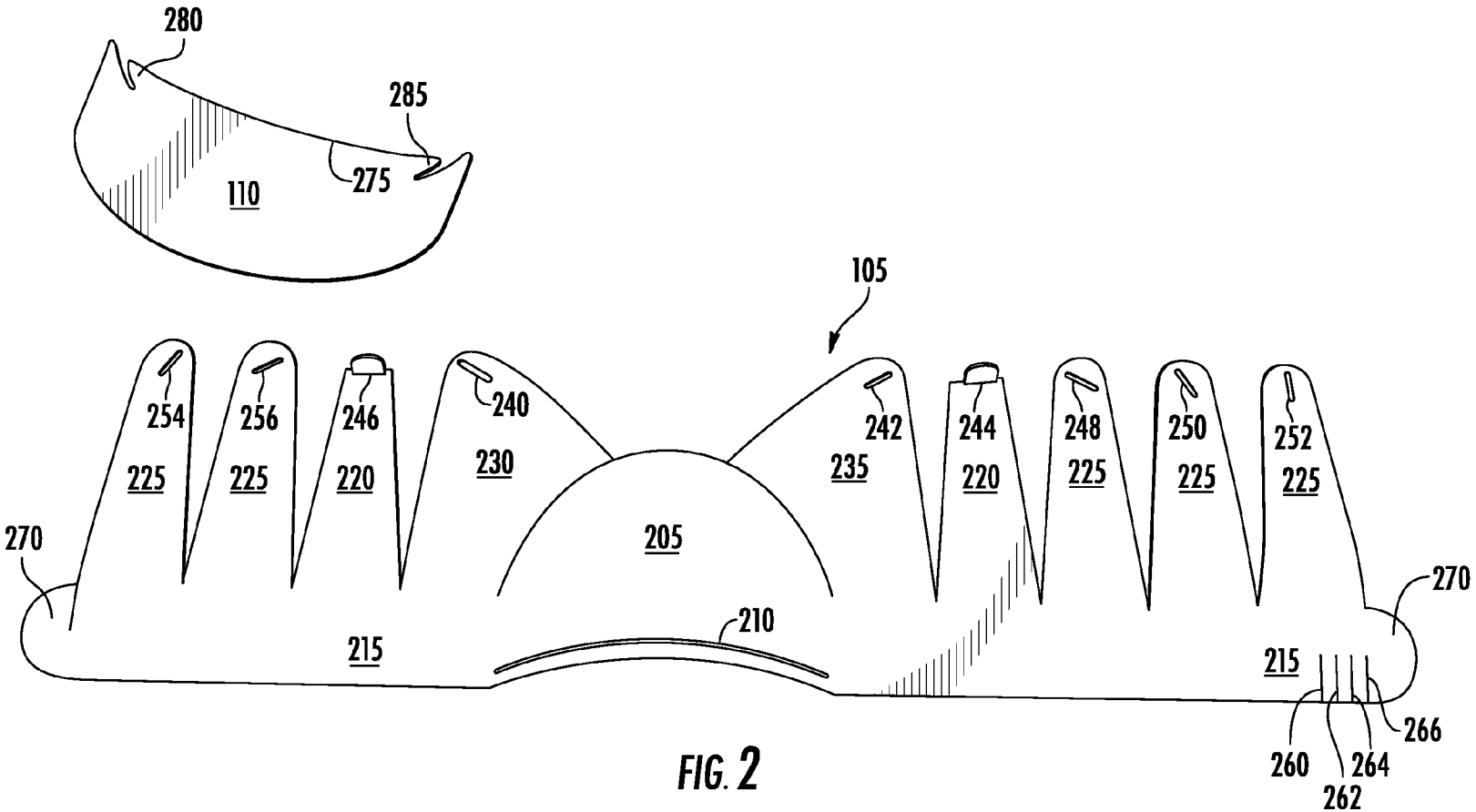
FIG. 2 is a view of the collapsible hat in a fully flat or collapsed form according to an exemplary embodiment.

Referring now to FIG. 2, the collapsible hat 100 is shown in a flat configuration. The collapsible hat 100 may be placed in the flat configuration, for example, during packaging for storage in a distribution center, during shipping from a distribution center to a retail location or customer, during display at a retail location, and/or during other situations. The flat configuration may be used by a user to transport the collapsible hat 100 in a manner that is less likely to result in the hat 100 being damaged than in the use configuration shown in the exemplary embodiment of FIG. 1.

The collapsible hat 100 may generally include two pieces of material, the brim 110 (e.g., a bill) and the main hat portion 105. In the illustrated embodiment, the main hat portion 105 includes a front portion 205, a band portion 215, and multiple top portions 220, 225, 230, and 235. In other embodiments, the main hat portion 105 may include fewer, more, or different portions and/or components than are illustrated in FIG. 2 and/or other figures. The brim 110 is detached from the rest of the collapsible hat 100. The brim 110 includes a brim connector 275 that can be inserted into a brim slot 210 of the front portion 205 of the main hat portion 105, coupling the brim 110 to the rest of the hat. The brim 110 further includes two tabs 280, 285 on either side of the brim connector 275 for securing the brim 110 when it is coupled to the main hat portion 105 via the slot 210 (see, e.g., FIGS. 7-8).

The main hat portion 105 includes a front portion 205. The front portion 205 includes the slot 210 for coupling the brim 110 to the rest of the hat. The front portion 205 and/or other portions of the hat 100 may be shaped in any manner, and the shape may be based on the intended use of the hat 100. For example, in one embodiment, in its fully formed or use state, the front portion 205 may take a generally slightly rounded shape similar to the front of, for example, a baseball hat. In another embodiment, the front portion 205 may be configured to include a portion that rises vertically into the air, similar to the front of a firefighter's hat.

The main hat portion 105 also includes a band portion 215. The band portion 215 extends from both sides of the front portion 205 when the hat is in its flat form. When forming the hat, the band portion 215 is wrapped around and the ends 270 of the two sides of the band portion 215 are configured to be coupled together, forming the circular base of the hat (see, e.g., FIG. 4). The band portion 215 includes slots or notches 260, 262, 264, and 266 that may be used to adjust the size of the hat 100. Adjustment of the size of the collapsible hat 100 allows the hat to better fit a variety of sizes and/or shapes of users' heads. Such adjustment may reduce the need to produce hats of different size to fit various users' heads.

The hat 100 includes multiple top portions (e.g., flaps, panels, strips, etc.) 220, 225, 230, and 235 extending from the band portion 215. The hat 100 includes at least one top connector portion 220 that includes a connector 244, 246 (e.g., tab, peg, protrusion, etc.) at the top (e.g., the end of the top connector portion 220 that will be near an approximate center of the main hat portion 105 in the fully formed or use configuration) of the top connector portion 220. The hat 100 also includes at least one top slot portion (e.g., top slot portions 225, 230, and 235) that includes a slot (e.g., slots 240, 242, 248, 250, 252, 254, and 256) at the top (e.g., the end of the top slot portion 225 that will be near an approximate center of the main hat portion 105 in the fully formed or use configuration) of the top slot portion 225. In some embodiments, such as the embodiment illustrated in FIG. 2, the hat 100 may include multiple top connector portions 220 and/or top slot portions 225. Multiple top connector portions 220 and/or top slot portions 225 may help increase the stability of the hat in the fully formed or use configuration. While the connectors and slots of the portions are shown at the end or tips of the portions, according to various exemplary embodiments, the connectors and slots may be located elsewhere on the portions.

Top portions 220, 225, 230, and/or 235 may have varying shapes and/or sizes, according to various exemplary embodiments. For example, in the exemplary embodiment shown in FIG. 2, the two top slot portions 230 and 235 nearest to the front portion 205 have a different shape than the other top portions 220 and 225. The top slot portions 230 and 235 nearest to the front portion 205 are larger and configured to cover more area of the top of the hat 100 (e.g., as compared to a single one of top portions 220 or 225) when the hat 100 is formed. Further, while the other top portions 220 and 225 are shown extending from the band portion 215, the two top connector portions 230, 235 nearest to the front portion 205 may extend from the band portion 215, the front portion 205, or both. The shapes of all top portions may vary. In some embodiments, the top portions 230 and 235 may be configured to provide a cover for most or all of the top of the main hat portion 105 when the hat is fully formed.

Figure 3:
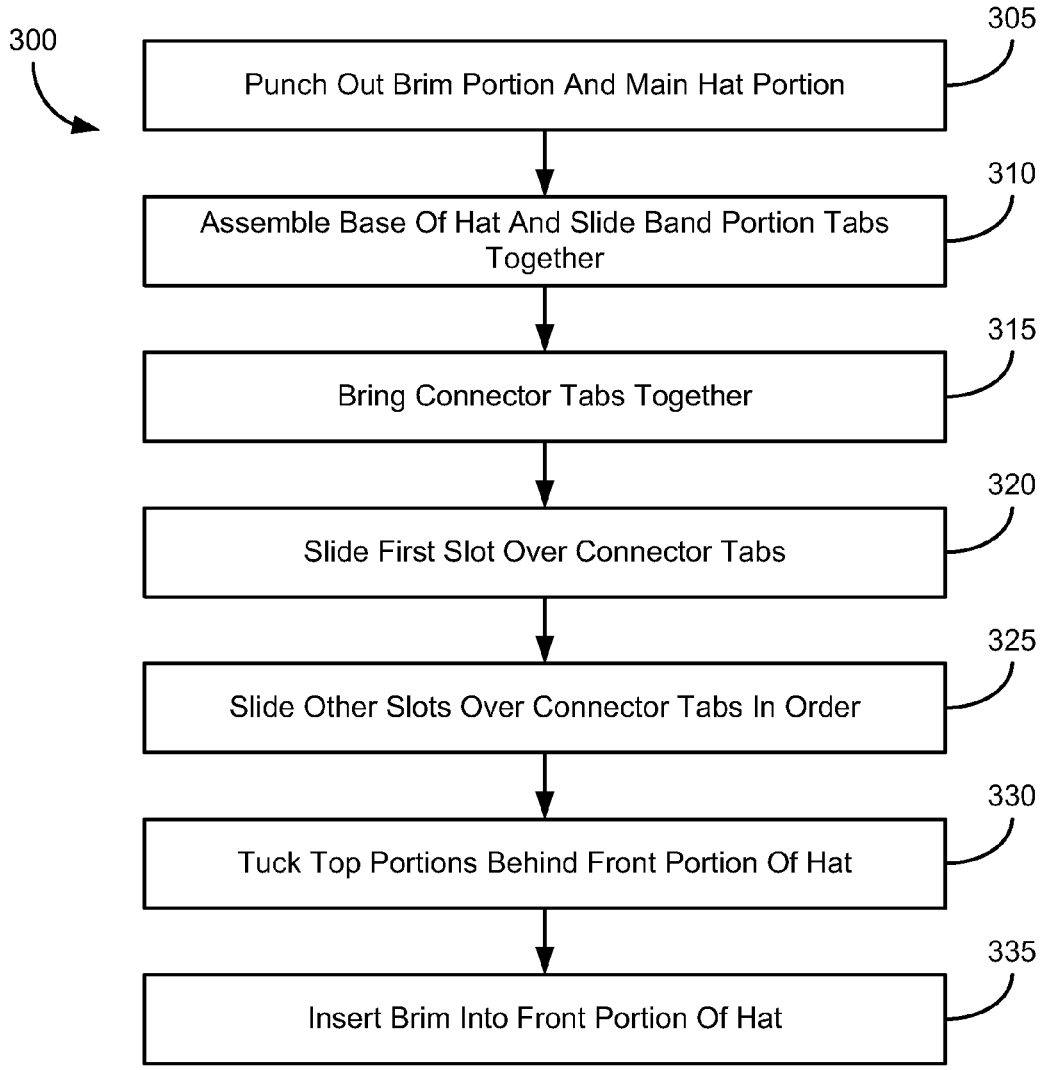
FIG. 3 is a flow chart of a process for assembling the collapsible hat according to an exemplary embodiment.

Referring now to FIG. 3, a flow chart of a process 300 for assembling the collapsible hat of the present disclosure is shown according to an exemplary embodiment. The process 300 includes punching out the brim portion and the main hat portion of the hat (step 305). Referring also to the flat form of the hat 100 of FIG. 2, the brim 110 and the main hat portion 105 may be part of a material (e.g., a piece of cardboard) and step 305 includes forming the shape of the brim 110 and main hat portion 105. Step 305 may additionally include any folding, cutting, or other transformation steps to generally form the shape shown in FIG. 2.

Figure 4:
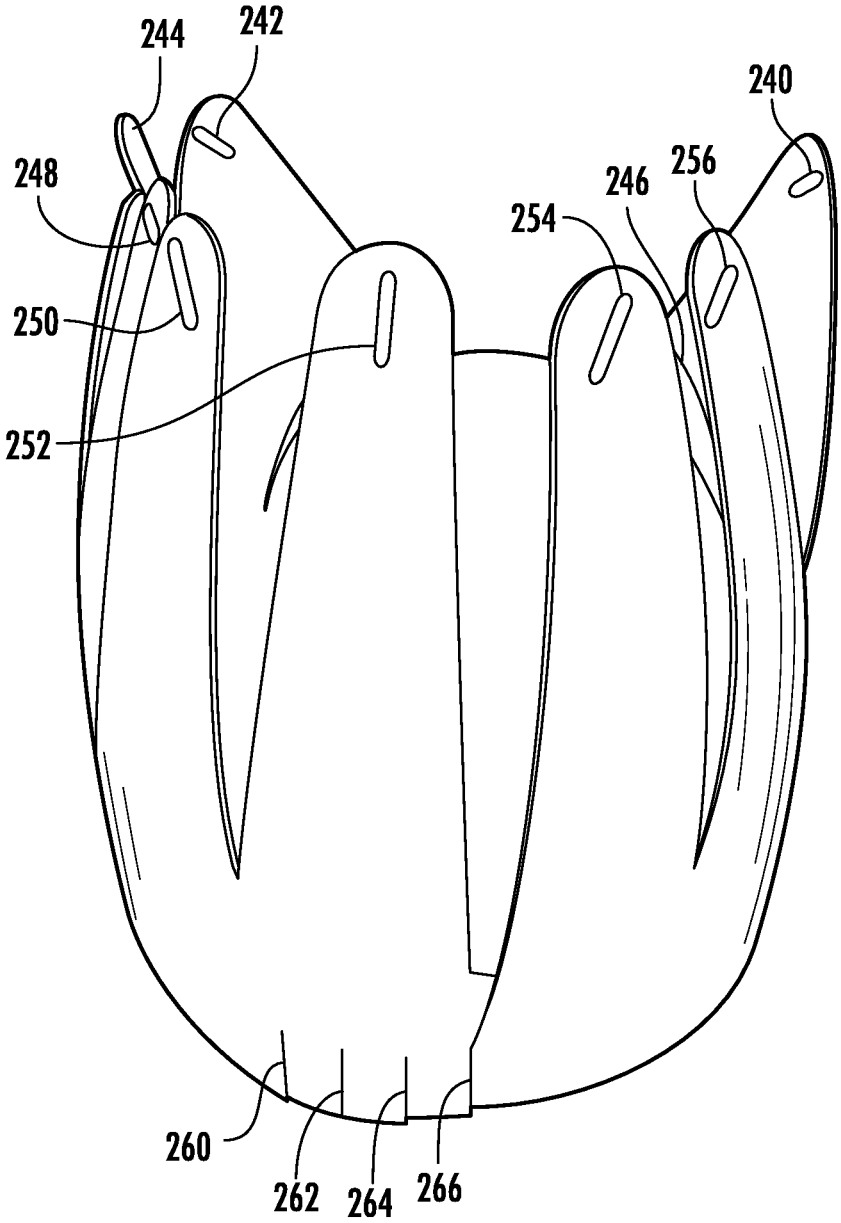
FIGS. 4-8 illustrate the assembly of the collapsible hat as described in the process of FIG. 3 according to an exemplary embodiment.

The process 300 further includes assembling the base of the hat 100 and sliding the band portion tabs 270 together (step 310). Referring also to FIG. 4, step 310 includes taking the flat form of the hat and creating a base for the hat by attaching the two tabs 270 of the band portion using the slots 260, 262, 264, or 266.

By sliding the tabs 270 into one of the slots 260, 262, 264, or 266, the back of the hat 100 may be secured such that the hat more properly fits the user's head. The multiple slots 260, 262, 264, and 266 are used to adjust the size of the hat 100. For example, if the tab 270 is inserted into the slot 260, the hat size is smaller than if the tab 270 is inserted into the slot 266. Inserting the tab 270 into the slot 266 results in the hat 100 having a largest size configuration. Inserting the tab 270 into the slot 264 results in the hat 100 having a second-largest size configuration. Inserting the tab 270 into the slot 262 results in the hat 100 having a second-smallest size configuration, and inserting the tab 270 into the slot 260 results in the hat 100 having a smallest size configuration. In various embodiments, any numbers, size, and/or shape of slots may be used to provide size adjustability to the hat 100.

According to one embodiment, the tabs 270 may further be adjusted to hold the back of the hat in place. The tabs 270 may be folded, twisted, or otherwise adjusted such that the tabs 270 do not slip out of the slot. According to other embodiments, the tabs 270 may not be adjusted after insertion into a slot.

Referring further to FIG. 4, by forming the base of the hat 100, the top portions 220, 225, 230, and 235 are shown in an upright position. From this position, the hat 100 may be formed via connecting the top portions 220, 225, 230, and 235 via process 300. The process 300 may generally include curving or bending the top portions 220, 225, 230, and 235 such that the hat 100 may be formed.

Figure 5:
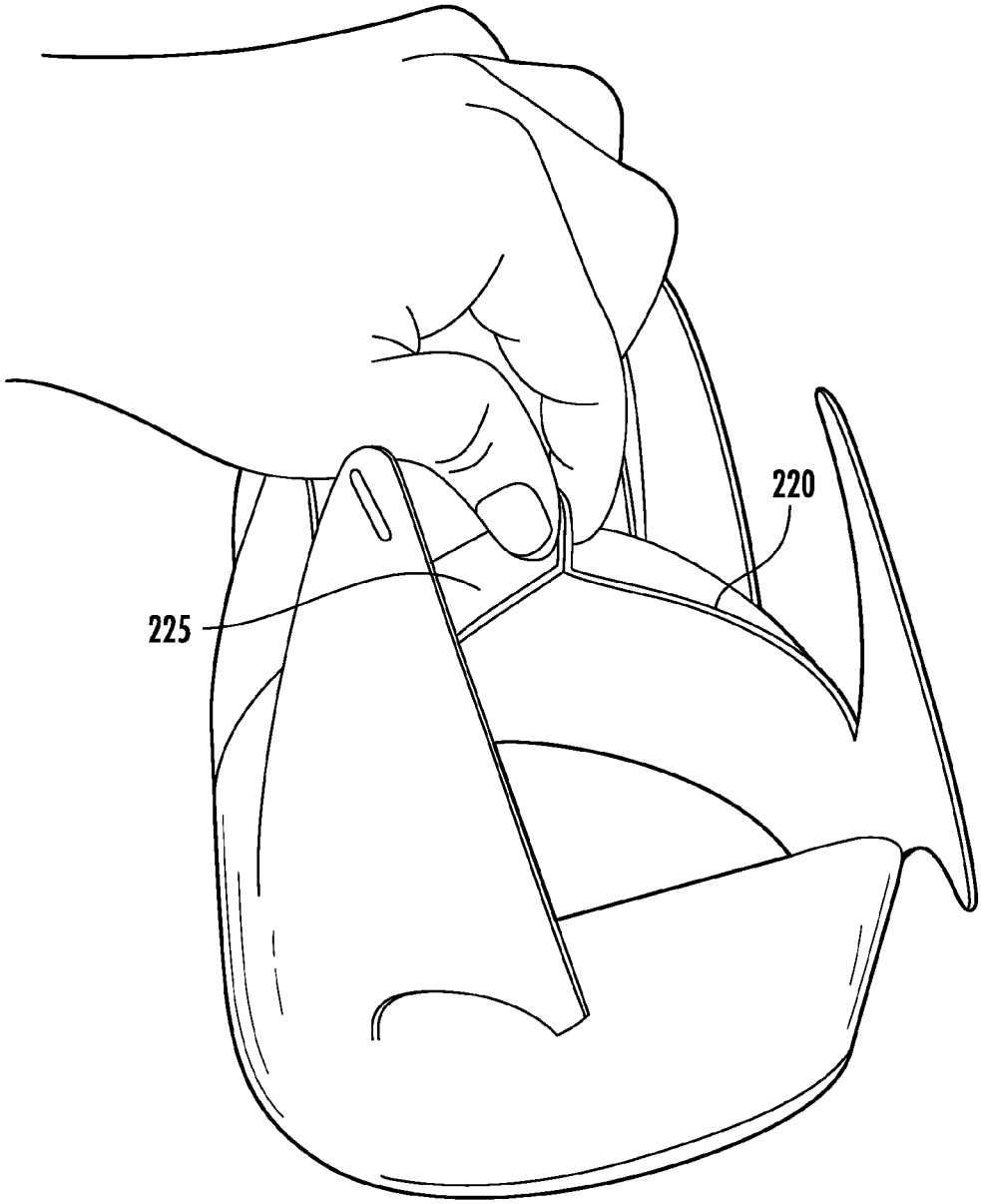

Referring back to the process 300 of FIG. 3, the process 300 further includes bringing the connector tabs 244 and 246 of portions 220 and 225 together (step 315). Referring also to FIG. 5, step 315 of bringing the connector tabs 244 and 246 together is shown according to an exemplary embodiment. The user of the hat 100 may manually push the connector tabs 244 and 246 together and hold them in place for inserting slots over. According to various exemplary embodiments, the user may hold the tabs 244 and 246 in place, the tabs or another portion of the hat may include fasteners for holding the tabs 244 and 246 in place, and/or another method for bringing the tabs 244 and 246 together may be used.

Figure 6:
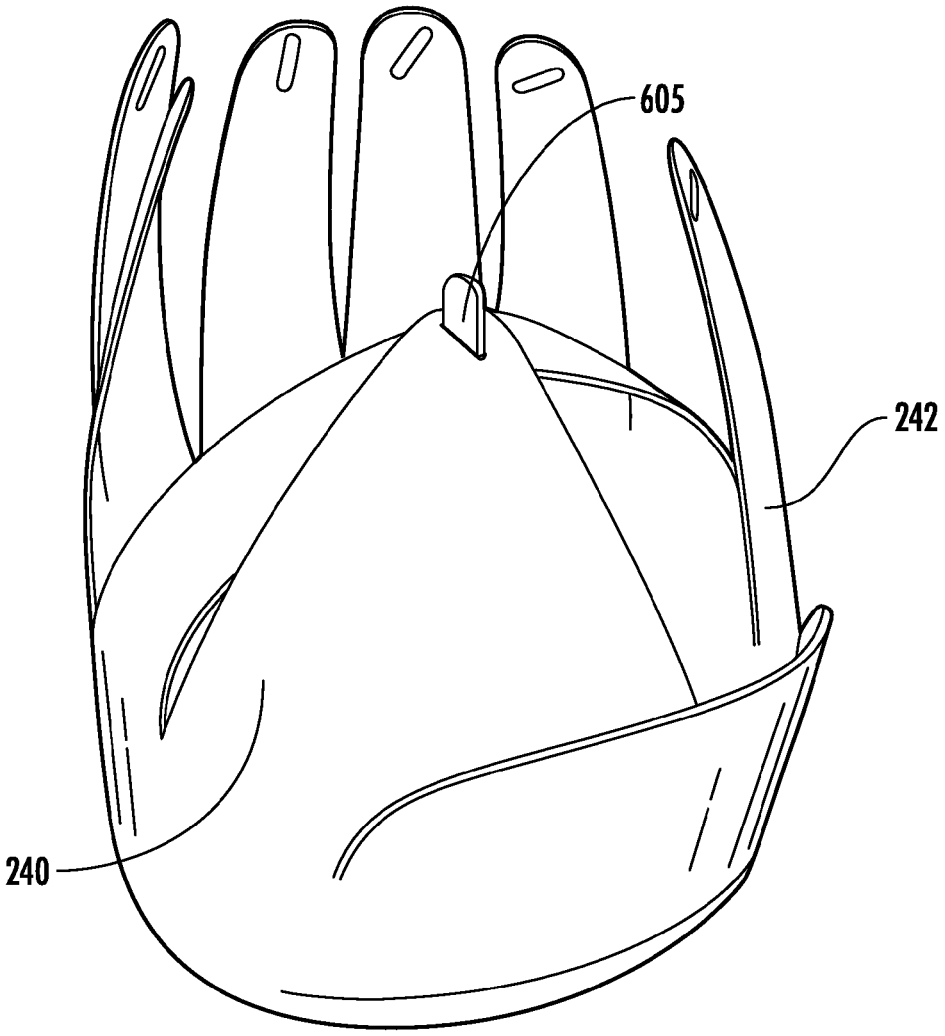

The process 300 of FIG. 3 further includes sliding the first slot over the connector tabs (step 320). Referring also to FIG. 6, the connector tabs 244 and 246 coupled together is shown to form the tab 605. The slot 240 of the portion 230 is shown slid over the connector tab 605, securing the position of the slot portion 230 and the position of the connector tab 605.

The process 300 of FIG. 3 further includes sliding the other slots over the connector tab 605 in order (step 325). According to one exemplary embodiment, the slots may be inserted over the connector tab 605 in a certain order. For example, referring also to FIG. 2, a slot from one side of the hat 100 (e.g., slot 248) may be slid over the connector tab 605 first, followed by a slot from the other side of the hat 100 (e.g., slot 256). The other slots are then slid over the connector tab 605 in an alternating fashion with regard to which side of the hat the slots are on. According to other various embodiments, the order of the insertion of the slots may be varied (e.g., the slots may be inserted clockwise, counterclockwise, or in any other order; the slots of the two largest slot portions may be inserted last instead of first; etc.).

The process 300 of FIG. 3 further includes tucking the top portions behind the front portion 205 of the hat (step 330). Referring generally to the figures, after assembly of the top portion of the hat 100, some top portions may be "sticking out", and step 330 includes tucking in such portions to create the rounded shape of the hat. For example, step 300 may include tucking in the slot portions 230 and 235 behind the front portion 205 of the hat.

Figure 8:
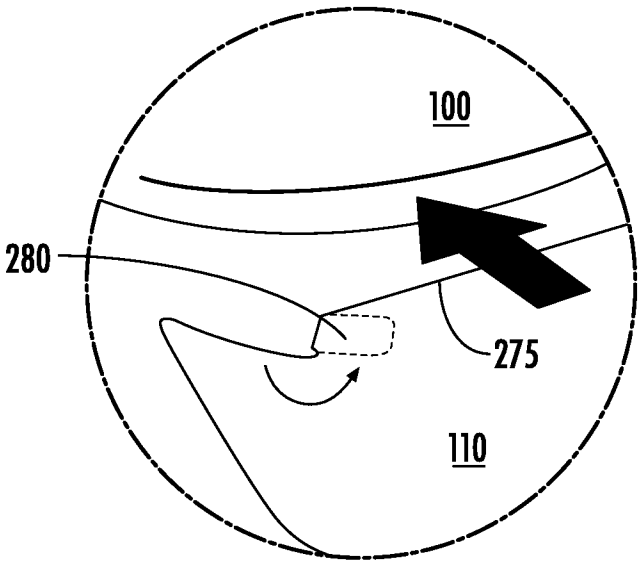
Figure 7:
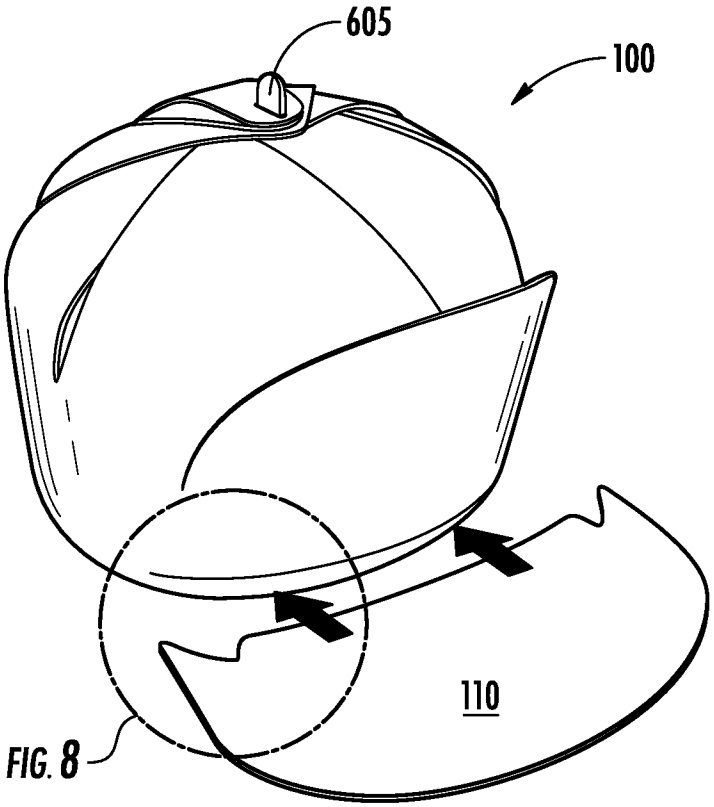

The process 300 of FIG. 3 further includes inserting the brim 110 into the front portion 205 of the hat (step 335). Referring also to FIGS. 7-8, the insertion of the brim 110 is shown in greater detail. The tabs 280 and 285 of the brim 110 may first be folded back or otherwise bent such that the brim connector 275 of the brim 110 may then be inserted into the slot 210 of the front portion 205. Once the brim connector 275 is slid into the slot 210, the tabs 280 and 285 of the brim 110 are then folded back or otherwise bent such that the position of the brim 110 is secured and that it does not fall out.

While the embodiments shown in the figures show two top portions with connectors and the other top portions with slots, it should be understood that the number of connectors and slots may be varied. For example, the collapsible hat may include one connector or more than two connectors into which slots are inserted over. As another example, the collapsible hat may include one or more portions with multiple connectors for which slots for every other portion are inserted over or multiple slots for which connectors may be inserted into. Further, while the embodiments shown in the figures illustrate the connectors and slots adjoining together at the top of the hat, it should be understood that the coupling of the connectors and slots may occur in another location of the fully formed hat (e.g., the front of the hat, back of the hat, etc.)

Figure 9:
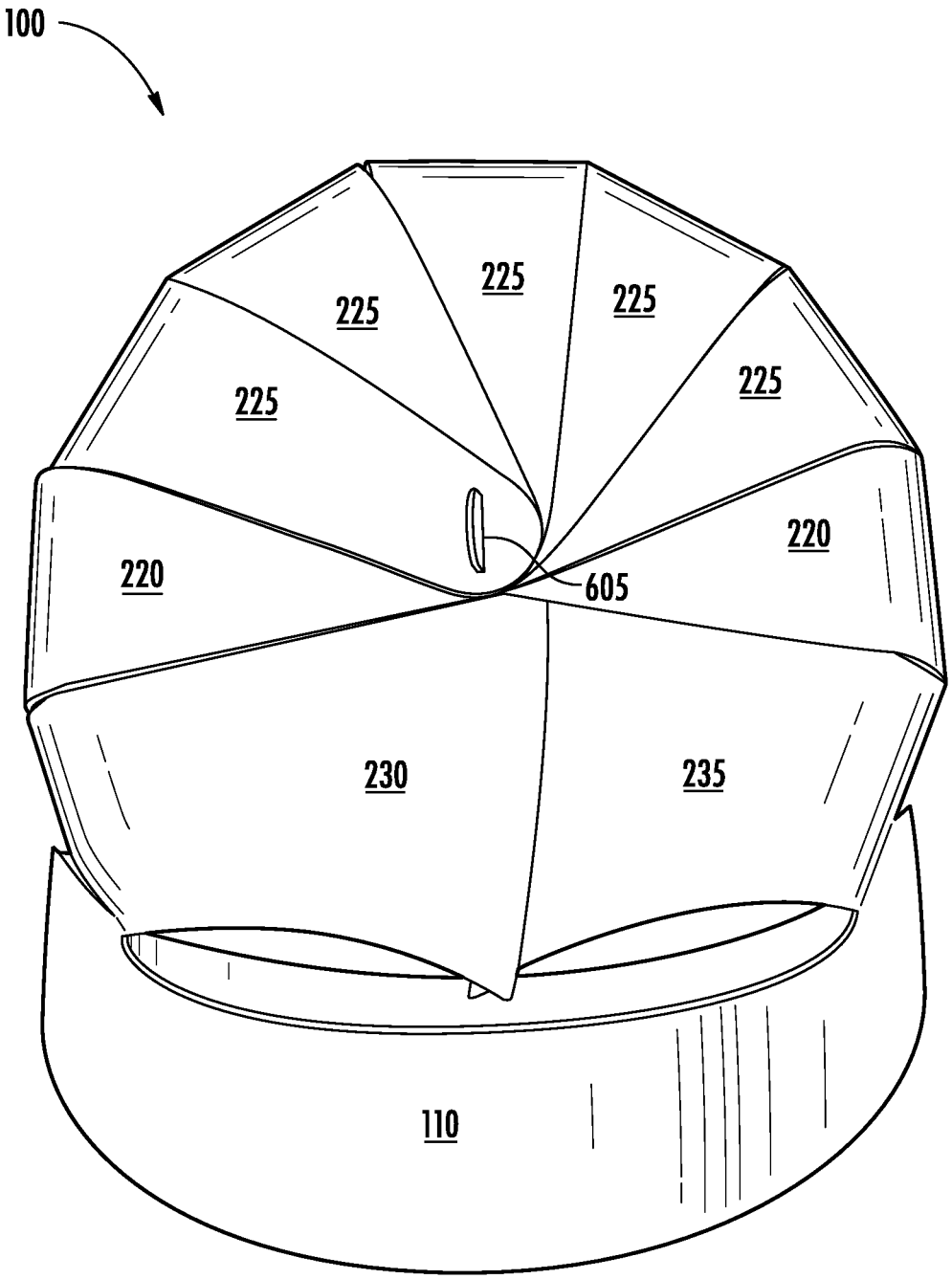
FIG. 9 is a top view of the fully formed collapsible hat according to an exemplary embodiment.
Figure 10:
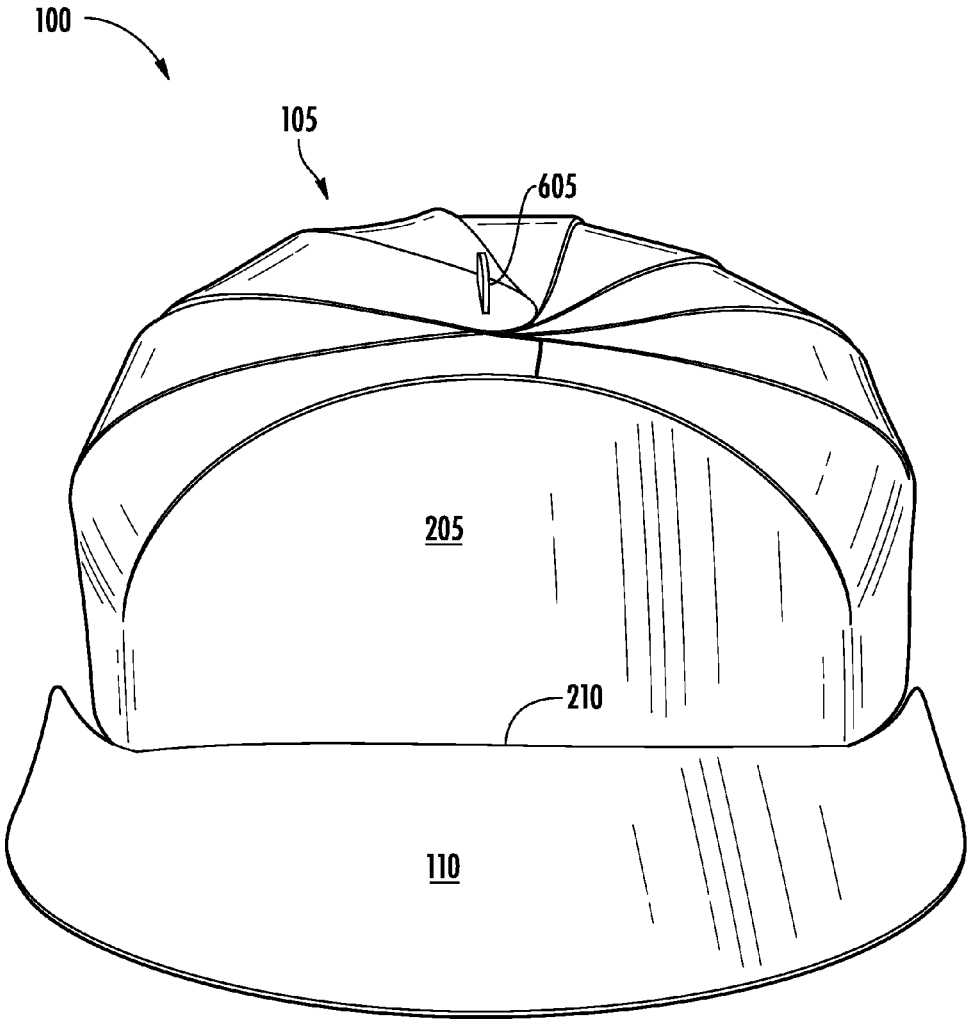
FIG. 10 is a front view of the fully formed collapsible hat according to an exemplary embodiment.

Referring now to FIGS. 9-10, the collapsible hat 100 is shown (in a top view and front view, respectively) in a fully formed state after all of the slots of all of the top slot portions 225, 230, and 235 are inserted over the connector tab 605. The top slot portions 225, 230, and 235 are shown to meet at the tab 605 at the top of the collapsible hat 100. The tab 605 may be at or near an approximate center of the main hat portion 105 or at a different position. In some embodiments, the tab 605 may be repositioned once they are coupled to the slots to secure the hat 100 in the use configuration. For example, the tab 605 may be folded or bent downwards to prevent the slots from dislodging.

In the configurations shown in the figures, the top portions 220, 225, 230, and 235 completely cover the top of the hat 100 without any gaps. In the illustrated exemplary embodiments, the connectors 230 and slots 235 are coupled such that the top portions 220 and 225 meet at a single point at an approximate center of the main hat portion 105. In other embodiments, the top portions may be designed in such a manner that they meet at a single point that is not at an approximate center of the main hat portion 105 (e.g., a point that is closer to the back of the hat 100 in a use configuration). In some embodiments, the top portions may be configured to meet at multiple points, such that some connectors are coupled to slots at one point and other connectors are coupled to other slots at a second point.

Figure 11:
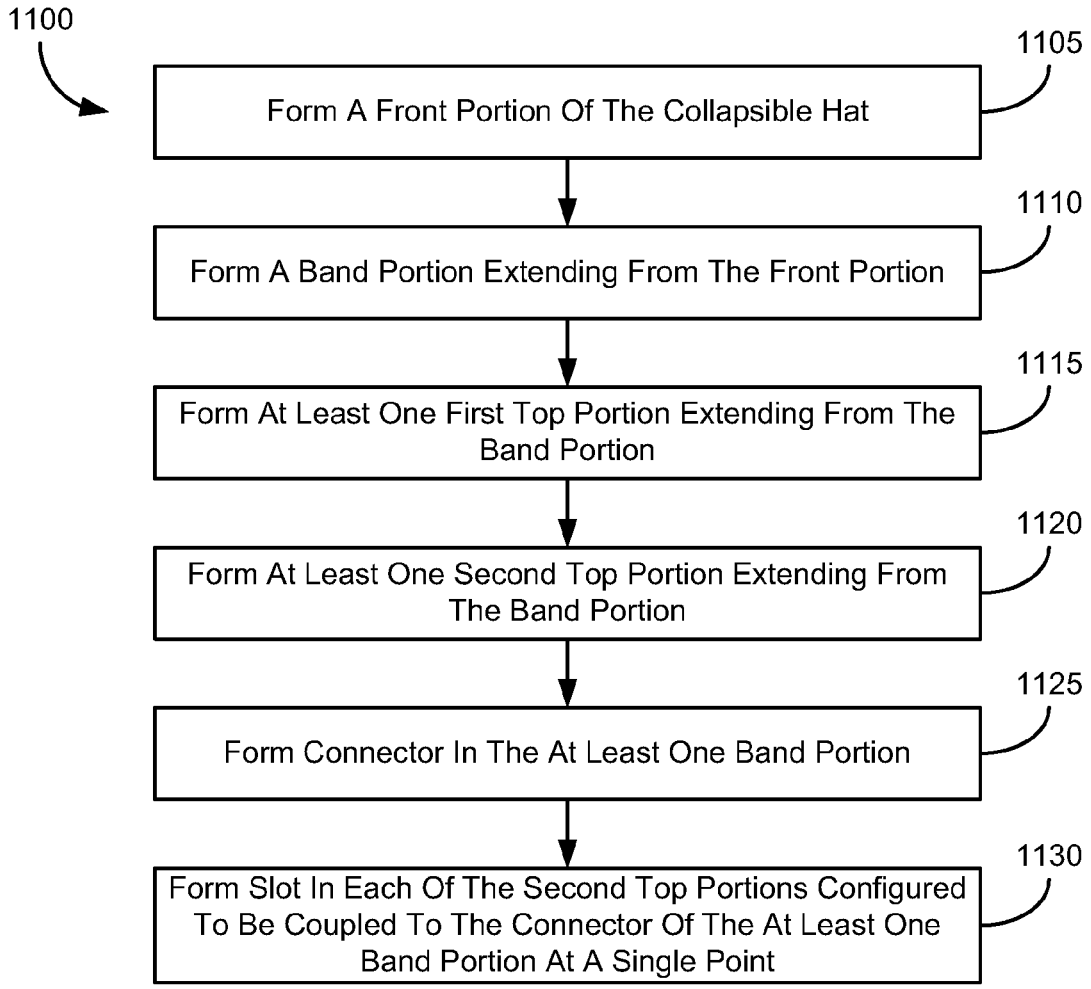
FIG. 11 is a flow chart of a process for producing the collapsible hat according to an exemplary embodiment.

Referring now to FIG. 11, a method 1100 of producing a collapsible hat such as hat 100 is shown according to an exemplary embodiment. Method 1100 includes forming a front portion of the collapsible hat (step 1105). A band portion is formed that extends from the front portion (step 1110). Several top portions are formed extending from the band portion, including at least one first top portion (step 1115) and a plurality of second top portions (step 1120). A connector is formed in the at least one band portion (step 1125), and a slot is formed in each of the plurality of second top portions that is configured to be coupled to the connector of the at least one band portion at a single point in a use configuration of the collapsible hat (step 1130). In some embodiments, the front portion, at least one band portion, at least one first top portion, plurality of second top portions, connector, and slots are formed using a single piece of material (e.g., via stamping and/or cutting).

The disclosure is described above with reference to drawings. These drawings illustrate certain details of specific embodiments that implement the systems and methods and programs of the present disclosure. However, describing the disclosure with drawings should not be construed as imposing on the disclosure any limitations that may be present in the drawings. The present disclosure contemplates methods, systems and program products on any machine-readable media for accomplishing its operations. The embodiments of the present disclosure may be implemented using an existing computer processor, or by a special purpose computer processor incorporated for this or another purpose or by a hardwired system. No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

The construction and arrangement of the collapsible hat as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

It should be noted that although the flowcharts provided herein show a specific order of method steps, it is understood that the order of these steps may differ from what is depicted. Also two or more steps may be performed concurrently or with partial concurrence. It is understood that all such variations are within the scope of the disclosure.

The foregoing description of embodiments of the disclosure have been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

What is claimed is:

1. A collapsible hat comprising:

a front portion;

at least one band portion extending from the front portion;

at least one first top portion extending from the at least one band portion and comprising a connector; and a plurality of second top portions extending from the at least one band portion;

wherein each of the plurality of second top portions comprises a slot;

wherein the connector of the at least one first top portion extends through the slots of the plurality of second top portions in a use configuration;

wherein, in the use configuration, a first band portion end is coupled to a second band portion end, such that the band portion forms a circular base of the collapsible hat; and wherein at least one of the first top portion and the plurality of second top portions extend from at least one of a side and a back of the band portion in the use configuration.

2. The collapsible hat of claim 1, wherein the front portion, at least one band portion, at least one first top portion, and plurality of second top portions comprise a single piece of material.

3. The collapsible hat of claim 2, wherein the material comprises cardboard.

4. The collapsible hat of claim 2, wherein the front portion, at least one band portion, at least one first top portion, and plurality of second top portions are positioned in substantially the same plane in a flat configuration.

5. The collapsible hat of claim 4, wherein the at least one first top portion and plurality of second top portions cover substantially all of a top of the collapsible hat in the use configuration.

6. The collapsible hat of claim 1, further comprising a detachable brim configured to be coupled to the front portion.

7. The collapsible hat of claim 1, wherein the at least one band portion comprises a first band portion having a first end extending from a first side of the front portion wherein the at least one band portion further comprises a second band portion having a first end extending from a second side of the front portion, wherein a second end of the first band portion is configured to be inserted into one of a plurality of slots of the second end of the second band portion to enable adjustment of a size of the collapsible hat.

8. A collapsible hat comprising:

a plurality of flaps configured to form a top portion of the collapsible hat, wherein the plurality of flaps comprise at least one first flap comprising a connector and a plurality of second flaps comprising a slot, wherein the plurality of flaps are configured to be coupled at a single point to form the top portion of the collapsible hat by inserting the at least one connector into each of the slots of the plurality of second flaps, and wherein the single point at which the plurality of flaps are configured to be coupled is proximate to a center of the top portion of the collapsible hat.

9. The collapsible hat of claim 8, further comprising:

a front portion; and at least one band portion extending from the front portion, wherein the plurality of flaps extend from the at least one band portion.

10. The collapsible hat of claim 9, wherein the front portion, at least one band portion, and plurality of flaps comprise a single piece of material.

11. The collapsible hat of claim 10, wherein the material comprises cardboard.

12. The collapsible hat of claim 10, wherein the front portion, at least one band portion, and plurality of flaps are positioned in substantially the same plane in a flat configuration.

13. The collapsible hat of claim 12, wherein the plurality of flaps cover substantially all of a top of the collapsible hat in the use configuration.

14. The collapsible hat of claim 9, further comprising a detachable brim configured to be coupled to the front portion.

15. The collapsible hat of claim 9, wherein the at least one band portion comprises a first band portion having a first end extending from a first side of the front portion wherein the at least one band portion further comprises a second band portion having a first end extending from a second side of the front portion, wherein a second end of the first band portion is configured to be inserted into one of a plurality of slots of the second end of the second band portion to enable adjustment of a size of the collapsible hat.

16. A collapsible hat comprising:

a front portion;

at least one band portion extending from the front portion;

at least one first top portion extending from the at least one band portion and comprising a connector; and a plurality of second top portions extending from the at least one band portion;

wherein each of the plurality of second top portions comprises a slot;

wherein the connector of the at least one first top portion extends through the slots of the plurality of second top portions in a use configuration;

wherein, in the use configuration, a first band portion end is configured to be coupled to a second band portion end, such that the band portion forms a circular base of the collapsible hat;

wherein at least one of the first top portion and the plurality of second top portions extend from at least one of a side and a back of the band portion in the use configuration; and wherein, in the use configuration, the connector of the at least one first top portion extends through the slots of the plurality of second top portions at a single point proximate to a center of a top portion of the collapsible hat formed by the at least one first top portion and the plurality of second top portions.

17. The collapsible hat of claim 16, wherein the front portion, at least one band portion, at least one first top portion, and plurality of second top portions comprise a single piece of material.

18. The collapsible hat of claim 17, wherein the front portion, at least one band portion, at least one first top portion, and plurality of second top portions are positioned in substantially the same plane in a flat configuration.

19. The collapsible hat of claim 18, wherein the at least one first top portion and plurality of second top portions cover substantially all of a top of the collapsible hat in the use configuration.

20. The collapsible hat of claim 16, wherein the at least one band portion comprises a first band portion having a first end extending from a first side of the front portion wherein the at least one band portion further comprises a second band portion having a first end extending from a second side of the front portion, wherein a second end of the first band portion is configured to be inserted into one of a plurality of slots of the second end of the second band portion to enable adjustment of a size of the collapsible hat.

* * * * *